United States Patent [19]

Shimabukuro

[11] Patent Number: 4,734,022

[45] Date of Patent: Mar. 29, 1988

[54] FLOOR-CONCRETE GRADER

[76] Inventor: Yoshinobu Shimabukuro, 33-15, 1-chome, Ohnakacho, Shuri, Naha-shi, Okinawa-ken, Japan

[21] Appl. No.: 920,534

[22] Filed: Oct. 20, 1986

[30] Foreign Application Priority Data

Oct. 21, 1985 [JP] Japan ..... 60-233418

[51] Int. Cl.[4] ..... B28B 1/08; E04G 21/10

[52] U.S. Cl. ..... 425/62; 425/456; 425/458

[58] Field of Search ..... 425/456, 458, 62

[56] References Cited

U.S. PATENT DOCUMENTS

| | | | |
|---|---|---|---|
| 2,656,161 | 10/1953 | Degen | 425/456 |
| 3,362,308 | 1/1968 | Austin et al. | 425/456 |
| 3,799,714 | 3/1974 | Vetovitz | 425/456 |
| 4,614,486 | 9/1986 | Bragaghini | 425/456 |

*Primary Examiner*—Willard E. Hoag
*Attorney, Agent, or Firm*—Armstrong, Nikaido, Marmelstein & Kubovcik

[57] ABSTRACT

A floor-concrete grader comprises a frame having a handle, a placing plate unit, which vertically vibrates along the frame, for placing a concrete floor surface and a rolling wheel. The placing plate unit is composed of three placing plates which are different from one another in the form of knife edge and height, the unit being vertically vibrated by a driving means such as a small engine. When the placing plate unit is drawn, while gripping its handle and being vertially vibrated along the frame, on the floor surface which has been just placed with concrete, the placing plates move while continuously placing the concrete floor surface to level the floor surface.

3 Claims, 8 Drawing Figures

FLOOR-CONCRETE GRADER

BACKGROUND OF THE INVENTION

1. Field of the Invention

The present invention relates to a floor-concrete grader for placing concrete, mortar or the like placed on the floor surface to level the concrete floor surface.

2. Description of the Prior Art

In the past, when concrete or mortar placed on the floor, a concrete leveler as shown in FIG. 6 is used to place the concrete floor surface. After the floor surface has been leveled out to some extent, the floor surface is further levelled evenly and finished. As described above, the conventional leveling work of floor concrete exclusively relies upon manual work, which is not yet now mechanized.

The floor concrete leveler as shown in FIG. 6 exclusively relies upon human power to place the concrete surface. Therefore, a severe heavy labor is compelled to require but it is difficult to level the floor surface evenly, extremely deteriorating the working efficiency. In addition, there is a further drawback in that finishing work has to be carried out to uniformly level the surface by means of a trowel or the like. In the past, the concrete placing work has already been mechanized but the leveling work has not yet been mechanized. Therefore, it requires many skilled operators for the leveling work, thus entailing extremely poor working efficiency. In light of this, it has been desired to realize the mechanization of the leveling work.

SUMMARY OF THE INVENTION

The leveling work of floor concrete is mechanized in accordance with the present invention. It is an object of the invention to provide a floor-concrete grader which evenly and effectively levels out the floor concrete surface and which is small and portable.

A further object of the invention is to provide a floor-concrete grader in which placing plates are vibrated by power driving of an engine or the like to level the floor-concrete surface.

The floor-concrete grader in accordance with the present invention comprises a placing plate unit composed of placing plates which vertically vibrates along a frame having a handle at an upper portion thereof to place a concrete-floor surface, a driving means for vertically vibrating the placing plate unit and a rolling wheel which rolls on the concrete floor surface.

When the placing plate unit is vertically vibrated along the frame by a driving means such as an engine and at the same time the handle is gripped by hands to draw the unit on the floor surface which has been just placed with concrete, the placing plates move while continuously placing the concrete floor surface to level out the floor surface.

Particularly, if three placing plates which are different from one another in the form of knife edge and height are provided, the first, the second and the third placing plates are deeply protruded in said order into concrete to place the concrete floor. Accordingly, the floor surface is roughly leveled out by the first placing plate, and are then evenly leveled out by the second and third placing plates. Particularly, the concrete floor is compacted by the first placing plate, and the floor surface is further evenly leveled out by the third placing plate.

DESCRIPTION OF THE PREFERRED EMBODIMENTS

Figure 1:
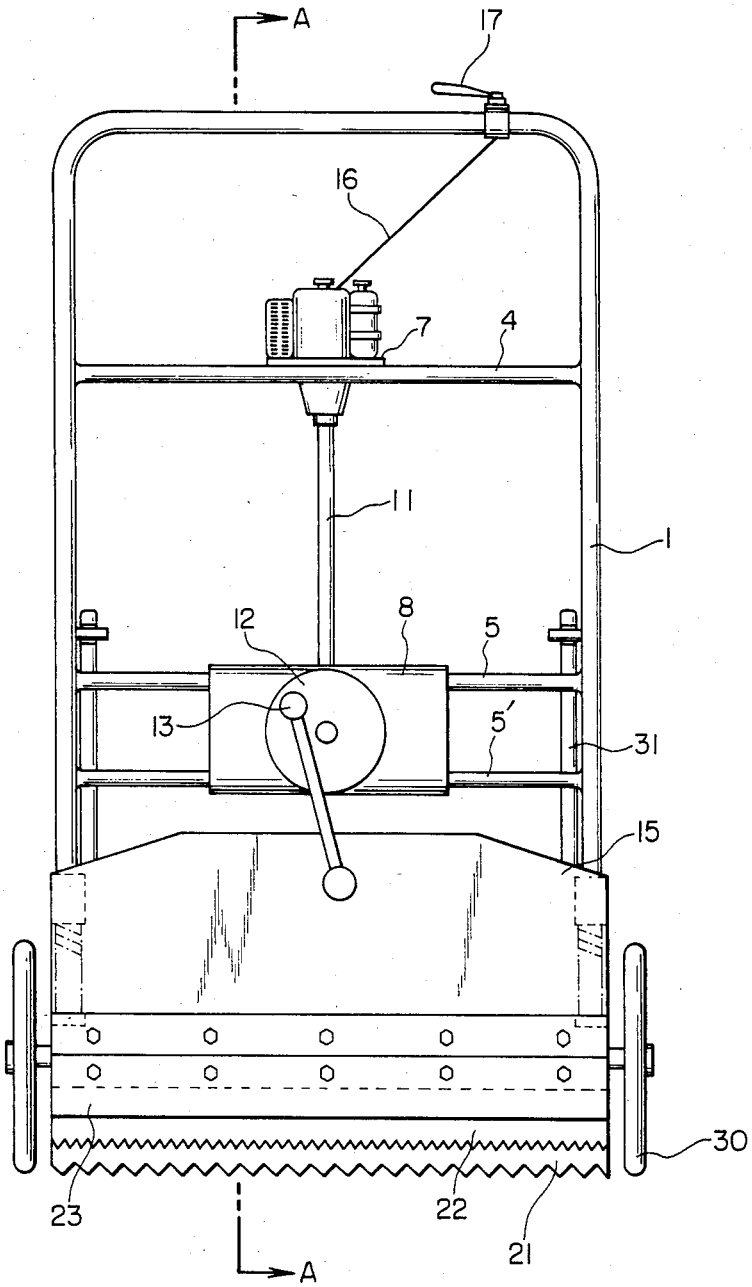
FIG. 1 is a front view of an embodiment according to the present invention.
Figure 2:
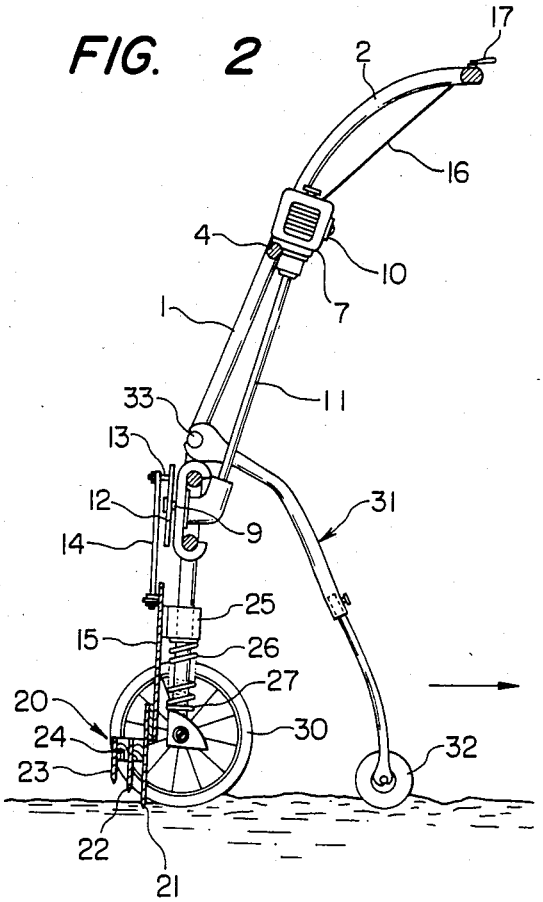
FIG. 2 is a sectional view taken on line A—A of FIG. 1.
Figure 3:
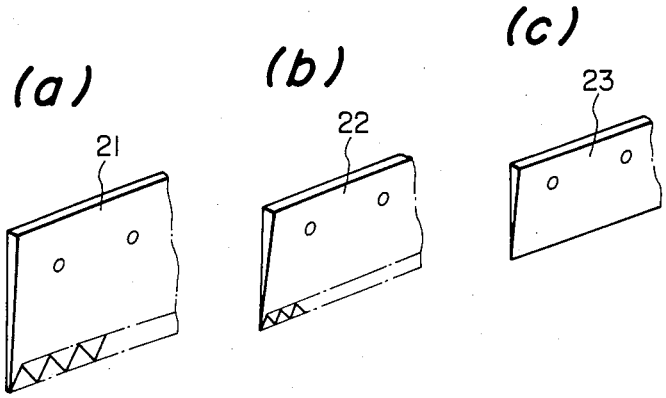
FIG. 3 shows edge constructions of placing plates, in which FIG. 3(*a*), 3(*b*) and 3(*c*) are partial perspective views of a first, a second and a third placing plates, respectively.
Figure 4:
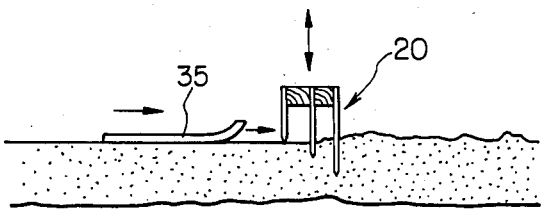
FIG. 4 shows a state of the placing plate during operation.

FIGS. 1 to 3 shows one embodiment of a floor concrete grader according to the present invention.

Reference numeral 1 designates a frame formed from a metal pipe or the like, the frame having an upper portion being bended frontwardly to form a handle 2, the frame 1 further having a central portion slightly bended as shown in FIG. 2 and having a rolling wheel 30 at an lower end thereof. Reference numeral 10 designates a small engine, which is a driving means mounted on a cross rod 4 of the frame 1 through a bracket 7, and the rotative driving force of the engine is transmitted to a rotary plate 12 through an operatively conencted shaft 11. The rotary plate 12 is secured to a rotary shaft 9 supported on a mounting bracket 8 provided on cross rods 5, 5' in the central portion of the frame 1 as shown. The transmission shaft 11 and the rotary shaft 9 are arranged obliquely as shown, which are driven by a suitable an oblique transmission mechanism such as a bevel gear. A mounting pin 13 is provided in an eccentric position of a rotary plate 12, and an operative rod 14 is provided between the mounting pin and a placing-plate mounting plate 15 on which the placing plate unit 20 is mounted, which will be described later, to constitute a so-called crank mechanism wherein the placing plate unit is reciprocated up and down by the rotation of the rotary plate.

The placing plate unit 20 is composed of a first placing plate 21, a second placing plate 22 and a three placing plate 23, totalling to three plates. Knife edges of these placing plates are such that the first plate 21 is in the form of saw teeth with a large pitch, the second plate 22 in the form of saw teeth with a smaller pitch than that of the first plate, and the third plate 23 in the form of a straight edge. These placing plates are spaced apart by spacers 4 and integrally mounted in the order of the first, second and third placing plates, from the forward end in the moving direction of the concrete grader and with the forward edges gradually increased in height in said order. The placing plate 20 is secured by means of screws or the like to the mounting plate 15 with the upper portion of the first placing plate 21 extended. The mounting plate 15 is secured at its upper portion to a slide guide shoe 25 fitted in the frame so that the shoe may be moved up and down. Reference numeral 27 designates a spring supporting flange secured to the frame, and a buffer spring 26 is retained between the flange 27 and the shoe 25 to always upwardly urge the guide shoe 25.

Reference numeral 32 designates an auxiliary wheel rotatably mounted on the forward end of a lever 31. The lever 31 is mounted on a mounting short rod 33 provided at the bend in the central portion of the frame and when not in use, the lever may be pivoted about the short rod to be folded. The lever 31 is disposed telescopically at the central portion thereof as shown in FIG. 2 to adjust the height position thereof.

Reference numeral 16 designates an engine operating electric rod formed from a flexible wire or the like, and 17 is an engine operating lever.

In the above embodiment, if the frame 1 is designed so that the angle of inclination may be adjusted in the vicinity of the mounting position of the cross rod 4, the height of the handle may be adjusted according to height of an operator without affecting the placing angle.

The floor-concrete grader of the present embodiment constructed as described above is operated in the procedure as follows:

When the engine 10 is started, the rotary plate 12 is rotated through the operative rod 11 and the rotary shaft 9. When the rotary plate 12 rotates, the placing-plate unit mounting plate 15 is vibrated, by the crank mechanism, in the vertical direction along the frame 1 through the guide shoe 25. At that time, the vertical vibrations of the guide shoe are damped by the buffer spring 25, and therefore, the vibrations are not directly transmitted to the handle 2, and the operator is not affected by the vibrations. In the event that the engine is stopped, the guide shoe 25 is urged upward by the spring to retain the placing plate unit at the upper position.

The placing plate unit is vibrated up and down by the vertical vibration of the mounting plate 15 to place the concrete surface which has been placed by the three placing plates.

In such a state, when the operator grips the handle 2 to draw the grader in the direction as indicated by the arrow, the first placing plate 21 first deeply places the rough surface into which concrete has been placed to compact the concrete to form a generally even surface. At this time, the edge surface of the first placing plate 21 presents a saw-tooth edge having a large pitch, and the plate 21 may be deeply broken into the concrete without imposing an excessive load thereon. Thereafter, the second placing plate 22 places the concrete floor surface, in which case the plate 22 is broken into the floor surface somewhat shallower than the first plate to further level out the floor surface leveled out by the first plate. The edge of the second placing plate 22 also presents a saw-tooth edge, and therefore it may be easily broken into the concrete. However, the pitch of the edge of the second plate is smaller than that of the first plate, and therefore, the second plate may level out the floor surface more densely. Finally, the floor surface leveled out by the first and second placing plates is more evenly leveled out by the third placing plate 24 in the form of a straight edge to finish the floor surface. The third plate finely strikes the concrete floor surface to apply vibrations thereto to level out the floor surface, and the third plate is rarely broken into the concrete. The upward and downward vibrations of the placing plate unit may be easily varied by varying the number of revolutions of the engine.

As described above, the concrete grader in accordance with the present invention is power driven, and the concrete floor surface is placed by three placing plates which are differenct from one another in the form of edge and height. Therefore, compacting of concrete after being placed and leveling-out of floor surface are simultaneously carried out efficiently. Furthermore, the concrete floor surface may be easily moved by the rolling wheel 30 and the auxiliary wheel 32. In addition, when not in use, the auxiliary wheel 32 can be folded, and therefore no space is required for carrying or storage thereof.

In the event the floor surface, which has already been leveled out by the present concrete grader, has to be finished more finely, a grader 35 may be connected to the frame 1 through a rope so that the grader may be drawn after the third placing plate 23.

Figure 5:
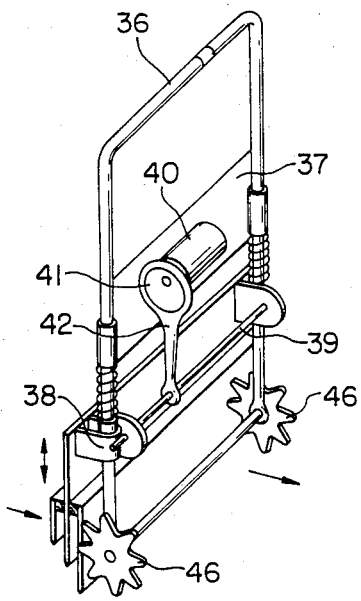
FIG. 5 is a perspective view showing a further embodiment of the present invention.
Figure 6:
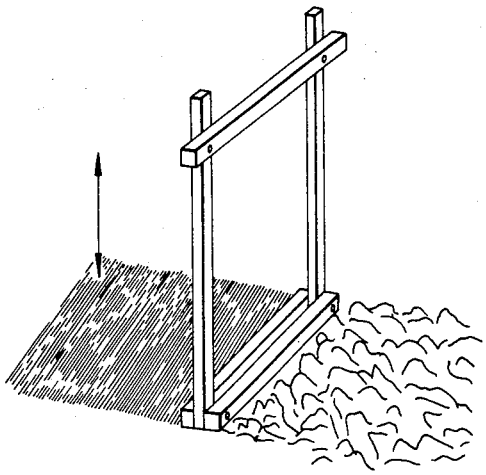
FIG. 6 is a perspective view of a conventional concrete-floor grader.

FIG. 5 shows a further embodiment of the present invention.

In this embodiment, an electric motor 40 is used in place of the engine as a driving source in the previous embodiment. Therefore, this grader is suitable for use where a power supply is available. The motor 40 is secured to a motor securing plate 37 secured to a frame 36. To the motor shaft is secured an eccentric cam 41, and the rotation of the cam causes a follower 42 to be moved up and down, the follower 42 being mounted on a connecting rod 39 connecting a slide guide shoe 38 to which the placing plate unit 45 is mounted. The upward and downward movement of the follower 42 causes the upward and downward movement of a placing plate unit 45 along the frame 36 for vibrations. The placing plate unit 45 is designed similarly to that of the previous embodiment. In this embodiment, a rolling wheel 46 employed has an outer peripheral surface having concavo-convexes in the shape of a star.

While in the above-described embodiments, three placing plates are provided, it is to be noted that in the present invention, the plates are not limited to three in number but two or four plates may be used for example. Furthermore, only the third placing plate is left while removing the others, and can be used as a vibrator for executing a self-leveling floor.

The present invention being constructed as described above, the invention has the following outstanding effects:

(a) Since the placing plates are vibrated by the power driving of the engine or the like to level out the floor concrete surface, the heavy labor caused by conventional manual work may be released, and in addition, it is possible to materially enhance the working efficiency as compared with that of prior art.

(b) Since the concrete floor surface is placed by the plurality of placing plates different from one another in the form of edge and height, the leveling is shifted from rough mode to fine mode to provide uniform and effective leveling. In addition, since the first placing plate is deeply broken into the concrete, it is possible to enhance the compacting effect of concrete.

(c) The grader may be easily moved on the concrete floor surface by the rolling wheel.

(d) The grader is simple in construction and small to be conveniently carried. Therefore, it can be used in any place irrespective of scales of construction work.

What is claimed is:

1. A vibrating grading device comprising:

a frame having a handle;

a plurality of mutually facing vertically spaced plates supported by said frame and vertically vibratable with respect to said frame;

a driving means fixed on said frame for vertically vibrating said plates; and a rotatable wheel mounted on said frame for movably supporting said frame on a floor surface.

2. A vibrating grading device according to claim 1, wherein each of said plurality of plates has a different bottom knife edge and height from others of said plurality of plates.

3. A vibrating grading device according to claim 1, wherein said driving means is a small-power engine.

* * * * *